US005500657A

United States Patent [19]

Yauchi et al.

[11] Patent Number: 5,500,657

[45] Date of Patent: Mar. 19, 1996

[54] AIR-BUBBLE DETECTION APPARATUS OF INK JET RECORDING HEAD, AND METHOD AND APPARATUS FOR RESTORING INK JET RECORDING HEAD

[75] Inventors: Hitoshi Yauchi; Koichi Sugiyama; Akihiko Miyashita, all of Morioka; Nakatoshi Satoh; Tatsuo Sugawara, both of Takizawa; Hiroyuki Sato; Takashi Onozato, both of Morioka, all of Japan

[73] Assignee: Alps Electric Co., Ltd., Tokyo, Japan

[21] Appl. No.: 971,497

[22] Filed: Nov. 3, 1992

[30] Foreign Application Priority Data

| | | | |
|---|---|---|---|
| Nov. 11, 1991 | [JP] | Japan | 3-294246 |
| Nov. 11, 1991 | [JP] | Japan | 3-294247 |
| Dec. 6, 1991 | [JP] | Japan | 3-322691 |

[51] Int. Cl.[6] ..... B41J 2/01

[52] U.S. Cl. ..... 347/9; 347/92

[58] Field of Search ..... 346/140 R, 75; 347/92, 9

[56] References Cited

U.S. PATENT DOCUMENTS

| | | | |
|---|---|---|---|
| 4,293,867 | 10/1981 | Isayama | 346/140 R |
| 4,498,088 | 2/1985 | Kanayama | 346/140 R |
| 4,518,974 | 5/1985 | Isayama | 346/140 R |

FOREIGN PATENT DOCUMENTS

| | | | |
|---|---|---|---|
| 58-51160 | 3/1983 | Japan | 347/92 |
| 59-120486 | 6/1984 | Japan . | |

*Primary Examiner*—Benjamin R. Fuller
*Assistant Examiner*—Craig A. Hallacher
*Attorney, Agent, or Firm*—Guy W. Shoup; Patrick T. Bever

[57] ABSTRACT

An air-bubble detection apparatus which detects the presence or absence of the occurrence of air bubbles in an ink passage by detecting if the voltage which develops across an electrostrictive vibrator by mechanical strain as a result of the ink in the ink passage of an ink jet recording head being moved, exceeds an excess voltage above a drive voltage. In addition, a method and apparatus for restoring the recording head to its operating condition, which prevents ink and energy from being wasted and makes efficient printing possible by restoring the recording head in which the occurrence of air bubbles is detected by using the above air-bubble detection apparatus.

6 Claims, 11 Drawing Sheets

AIR-BUBBLE DETECTION APPARATUS OF INK JET RECORDING HEAD, AND METHOD AND APPARATUS FOR RESTORING INK JET RECORDING HEAD

BACKGROUND OF THE INVENTION

1. Field of the Invention

The present invention relates to an apparatus for detecting air bubbles in an ink jet recording head of an ink jet recording apparatus which performs recording by jetting ink droplets from a nozzle, as well as a method and apparatus, using the same detection apparatus, for recovering the ink jet recording head.

2. Description of the Related Art

Generally, a plurality of ink passages whose extreme end portions are formed into nozzles are arranged inside an ink jet recording head unit, in an on-demand type ink jet recording apparatus which produces ink droplets only when required, by changing the capacity of the ink passages by electrostrictive vibrators. At least some of the outer peripheral walls of these ink passages are formed from flexible members, and electrostrictive vibrators are provided on the outer peripheral walls. By supplying electric current to the electrostrictive vibrators at predetermined printing times, the area of the cross section of the ink passages is decreased, and ink within the ink passages is jetted from the nozzles to the paper. Thus, printing is performed.

In such an ink jet recording apparatus, a problem occurs when air bubbles are mixed into or generated in the ink passages of the recording head, filled with ink, namely, ink is not discharged. That is, if there are air bubbles in the ink passages, changes in the capacity of the passages by the electrostrictive vibrator, is absorbed by changes in the atmospheric pressure of the air bubbles. Thus, proper ink droplets cannot be jetted.

For this reason, a mechanism which has been proposed hitherto for detecting the occurrence of air bubbles inside the ink passages is disposed in the ink jet recording apparatus so that the discharge condition can be restored by removing air bubbles by a restoring apparatus when the occurrence of the air bubbles is detected.

Hitherto, various means have been proposed for detecting air bubbles in the ink passages, such as those disclosed in Japanese Utility Model Laid-Open No. 59-5570, or Japanese Patent Laid-Open No. 60-262655 and 63-141750.

However, these means require special parts to be used, parts specially constructed, or complex determination methods when these means are manufactured.

According to the above Japanese Utility Model Laid-Open No. 59-5570, a resistor is inserted into either one of the electrostrictive vibrators, and the voltage which develops at the end point of this resistor is compared with the voltage at the end point of the resistor when a capacitor and resistor are connected in series, driven in the same manner as the electrostrictive vibrators. In this method, a resistor must be inserted into each electrostrictive vibrator when a plurality of jet heads are prepared. Thus, the manufacturing method is complex.

According to the above Japanese Patent Laid-Open No. 60-262655, a voltage waveform which develops at the end point of the electrostrictive vibrator is divided by a Zener diode and a resistor so as to efficiently detect a vibration voltage. A sufficient backward electric current is required in order for the Zener diode to be in a fixed voltage range. The voltage of the electrostrictive vibrator generated by mechanical strain usually cannot supply this electric current sufficiently. The vibration voltage to be obtained attenuates, thus a sufficient amplitude cannot be supplied to the voltage comparator.

According to the above Japanese Patent Laid-Open No. 63-141750, the cycle of the vibration is measured to detect the presence of air bubbles. A counter or timer for measuring the cycle is required. This has the same drawback as Japanese Utility Model Laid-Open No. 59-5570 in that the circuit becomes quite large when a plurality of jet nozzles are driven simultaneously.

SUMMARY OF THE INVENTION

The present invention has been achieved in view of the above-described circumstances.

A first object of the present invention is to provide an apparatus for detecting air bubbles in an ink jet recording head, which is simple in construction and has sufficient resolution, and is capable of detecting air bubbles even in a plurality of jet heads at a low cost.

A second object of the present invention is to provide a method of and apparatus for recovering an ink jet recording head, which is capable of restoring the discharge condition of the recording head without wasting ink or energy when air bubbles in the ink passages are detected.

A third object of the present invention is to provide a method of and apparatus for restoring an ink jet recording head, which reduces the consumption of ink and is capable of shortening the restoring operation time.

A fourth object of the present invention is to provide an apparatus for detecting air bubbles in an ink jet recording head, having air bubbles detecting means for detecting the occurrence of air bubbles in the ink passages by detecting whether the voltage which develops at electrostrictive vibrators by mechanical strain arising from the movement of the ink in the ink passages of the ink jet recording head is an excess voltage above a driving voltage.

A fifth object of the present invention is to provide an air-bubble detection apparatus of an ink jet recording head, said ink jet recording head having a plurality of nozzles in which all the end points of a plurality of electrostrictive vibrators are made common and the other points are made independent driving points to obtain ink droplets, maintaining all the electrostrictive vibrators at a high electrical potential when ink droplets are not jetted, driving a necessary driving point temporarily at a low electrical potential when ink droplets are obtained, and maintaining remaining electrostrictive vibrators at that electrical potential by using the nature of the electrical capacity of the electrostrictive vibrators to maintain the shape of the electrostrictive vibrators, said air-bubble detection apparatus comprising: jetting nozzle judgment means for detecting that it is driven at a low electrical potential and having a function for judging the output of the air-bubble detecting means at only the driving points of electrostrictive vibrators corresponding to the judgment means.

A sixth object of the present invention is to provide a method of restoring the ink jet head, in which air bubbles which occur in the ink passage of the ink jet head are removed, comprising the step of stopping the printing operation for at least the time during which detected air bubbles are diffused into the ink when the air bubbles have the size such that they can be diffused into the ink and disappear within a predetermined time.

A seventh object of the present invention is to provide an apparatus for restoring an ink jet recording head, wherein the nozzles in the respective extreme end portions of a plurality of ink passages are covered by capping means in such a manner for the nozzles to be opened and closed, and ink is discharged from each nozzle by selectively driving a plurality of piezoelectric elements corresponding to some of the ink passages in said ink jet recording head, said apparatus comprising: non-discharge detecting means for detecting for each nozzle from which nozzle ink is not discharged and outputting a non-discharge signal; pressurizing means for increasing the internal pressure inside the ink passages; and control means for driving piezoelectric elements corresponding to nozzles of which a non-discharge signal has been output at least at predetermined time intervals during which the non-discharge signal is being output in a state in which the internal pressure of each of the ink passages is increased by driving the pressurizing means when non-discharge signals from some of nozzles have been output from the non-discharge detecting means.

According to the above-described air-bubble detection apparatus of the ink jet recording head of the present invention, air bubbles in the ink jet recording head are detected continuously and inexpensively. Thus, abnormal printing can be prevented, and the means for removing the air bubbles can be operated. That is, starting of printing, detection of air bubbles, stoppage of driving, removal of air bubbles and restoration of not-yet printed portions can be realized successively as a series of operations. As a result, a normal printing operation accompanying automatic restoration can be realized for a long period of time.

According to the above-described method and apparatus for restoring the ink jet recording head of the present invention, in a case where air bubbles which occur in the ink passage are very small and diffused into the ink in a short time, the printing operation is discontinued for at least the time the air bubbles are diffused, causing the air bubbles to be diffused into the ink and disappear. Since the printing operation is restarted thereafter, the operation for restoring the ink jet head can be performed in a short time. Thus, the restoring operation using a restoring apparatus as in the prior art, which takes a long time, is obviated, making high-speed printing possible.

According to the above-described apparatus for restoring the ink jet recording head of the present invention, when non-discharge signals from some nozzles are output from the non-discharge detecting means to the control means, the control means drives piezoelectric elements only corresponding to the nozzles of which non-discharge signals are output or the piezoelectric elements corresponding to all the nozzles at predetermined time intervals during which the non-discharge detection signals are being output in a state in which the internal pressure of each of the ink passages is increased by driving the pressurizing means. As a result, if the non-discharge detection signals are no longer output, the restoring operation is immediately stopped at that time. Furthermore, since the restoring operation is performed by vibrating nozzles by driving the piezoelectric elements, earlier restoration is made possible, and the amount of ink consumed is made small.

The above and further objects and novel features of the invention will more fully appear from the following detailed description when the same is read in connection with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

Preferred embodiments of the present invention will be explained below with reference to the accompanying drawings.

Figure 1:
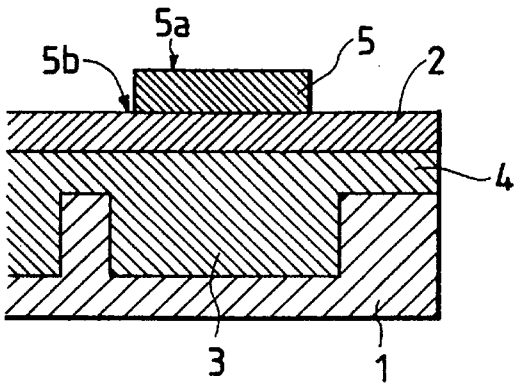
FIG. 1 is a perspective view illustrating the construction of an ink jet recording head used in the present invention.
Figure 2:
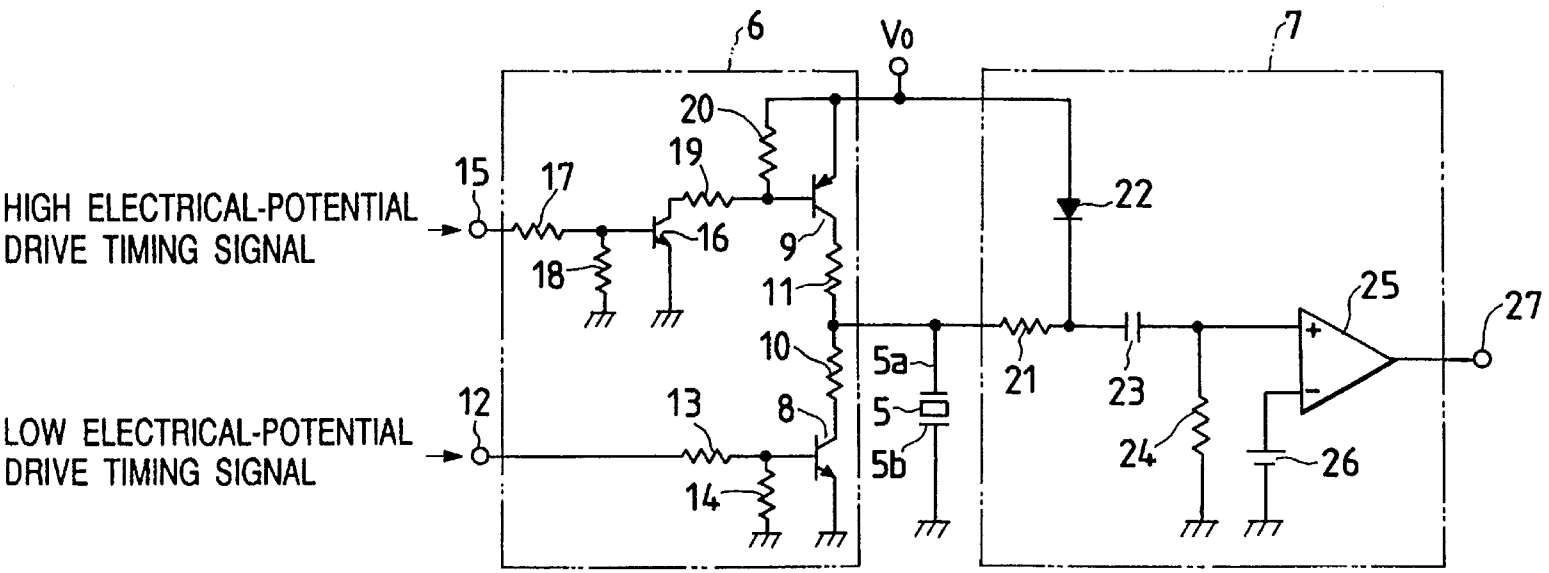
FIG. 2 is a circuit diagram of air-bubble detection for detecting excess voltage according to the present invention.
Figure 3:
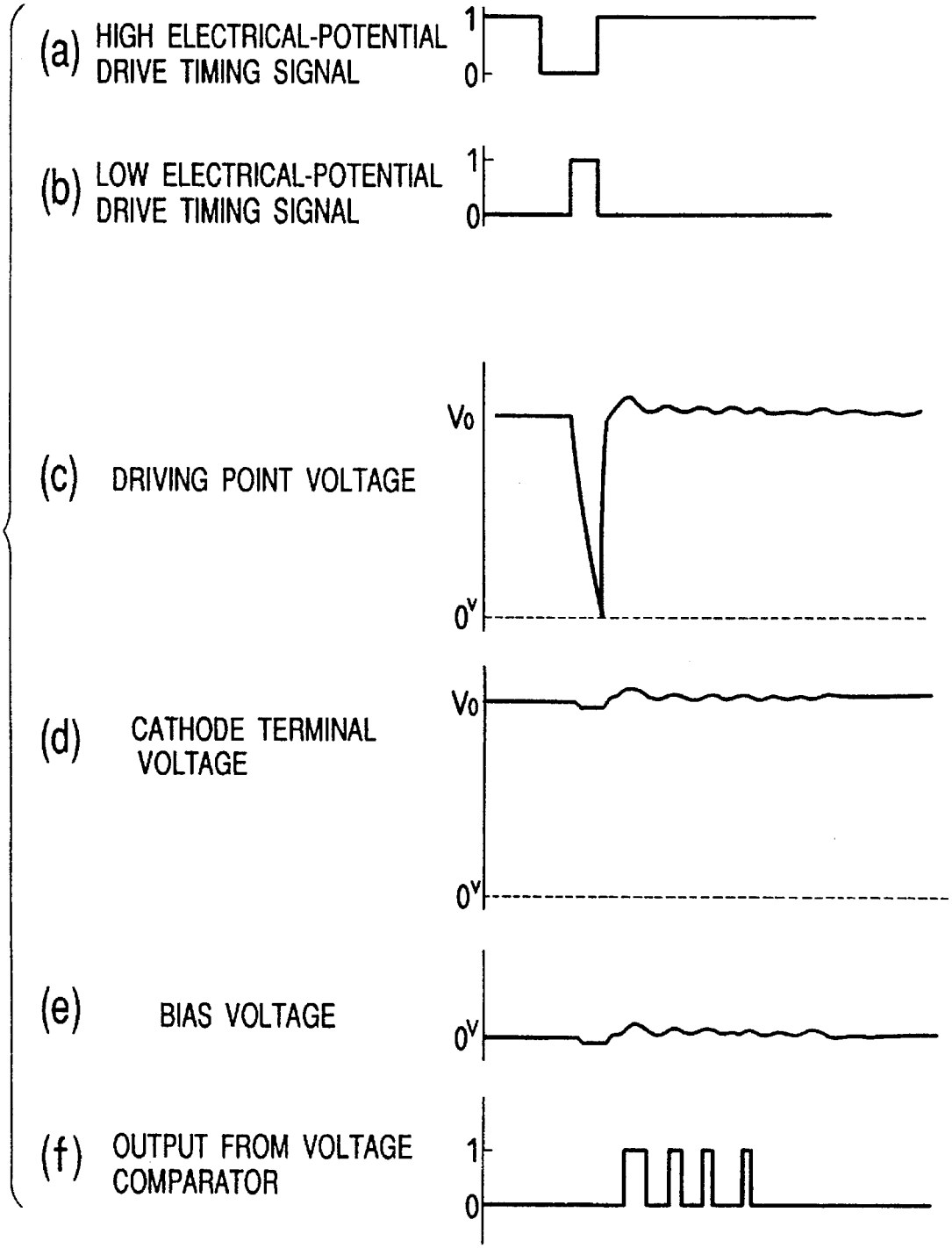
FIG. 3 is a waveform chart illustrating the voltage waveforms of each section of the circuits shown in FIG. 2.

FIGS. 1 through 8 show an embodiment of an air-bubble detection apparatus of an ink jet recording head used in the present invention. FIG. 1 shows the mechanical construction of the ink jet recording head used in the present invention; FIG. 2 shows an air-bubble detection circuit and a driving circuit used in the present invention; and FIG. 3 shows the waveforms of each section of the circuits shown in FIG. 2.

The ink jet recording head is formed in the following way. There is an ink passage 3 between a board 1 and a vibrating plate 2, both of which are joined, which is connected to the ink supply source. A nozzle 4 for discharging ink in the ink passage 3 is formed in the extreme end portion of the ink jet recording head. An electrostrictive vibrator 5 formed of a piezoelectric element or the like is fixed onto the surface of the vibrating plate 2 by an appropriate method.

As shown in FIG. 2, the electrostrictive vibrator 5 is driven by a driving circuit 6, and the occurrence of air bubbles is detected by an air-bubble detection circuit 7. In the driving circuit 6, a transistor 8 for decreasing the voltage across the electrostrictive vibrator 5 and a transistor 9 for increasing the voltage across the electrostrictive vibrator 5 are connected in series between drive voltage $V_0$ and the ground. That is, the two transistors 8 and 9 are connected to each other via two resistors 10 and 11, both of whose collectors are connected in series. The emitter of one of the transistors, 9, is connected to drive voltage $V_0$, and the other transistor 8 is grounded. A drive point 5*a* of the electrostrictive vibrator 5 is connected between the two resistors 10 and 11, and a ground point 5b is grounded. A low electrical-potential drive timing signal, input from an input terminal 12, is input to the base of the transistor 8 through bias resistors 13 and 14. A high electrical-potential drive timing signal which is input from an input terminal 15 is input to the base of the transistor 9 through a transistor 16. That is, a high electrical-potential drive timing signal is input to the base of the transistor 16 through bias resistors 17 and 18. The emitter of the transistor 16 is grounded, and the collector thereof is connected to the base of the transistor 9 through a resistor 19. A resistor 20 is connected between the emitter and the base of the transistor 9.

In the air-bubble detection circuit 7, a diode 22 is connected between a terminal of a resistor 21, the other terminal of which is connected to the drive point 5a of the electrostrictive vibrator 5, and drive voltage $V_0$. A capacitor 23 and a resistor 24 are connected in series from the cathode of the diode 22 and grounded. The connecting point of the capacitor 23 and the resistor 24 is connected to a +input terminal of a voltage comparator 25. A battery 26 for comparison voltage is connected to a −input terminal of the voltage comparator 25.

Next, the operation of this embodiment will be explained.

When ink is discharged from the ink jet recording head, high and low electrical-potential drive timing signals are input to input terminals 15 and 12, respectively, at the times shown in FIG. 3(*a*) and 3(*b*). As a result, the voltage applied between the drive point 5a and the ground point 5b of the electrostrictive vibrator 5 by the driving circuit 6 is changed.

If the voltage across the electrostrictive vibrator 5 is changed in this manner, a mechanical strain is caused in the electrostrictive vibrator 5. This mechanical strain causes such an electrical charge distribution as to cancel drive voltage $V_0$ to be present within the electrostrictive vibrator 5 and to maintain an equibrium condition with drive voltage $V_0$. The vibrating plate 2 is also mechanically strained in consequence of the mechanical strain of the electrostrictive vibrator 5. As a result, the capacity of the ink passage 3 changes, causing the ink in the ink passage 3 to be pushed out from the surface of the nozzle 4. The ink, if it starts moving, tries to continue to move by its inertial force in accordance with the driving. However, a stress for making it return to its original state acts due to the volume elasticity of the ink, thereby causing the ink to return in a backward, reverse direction after it is pushed out from the surface of the nozzle 4. The surface tension of the ink acts in the process of jetting, and some of the ink are separated as droplets. These separated droplets are jetted toward recording paper by its inertial force and used for printing.

On the other hand, the ink remaining in the nozzle 4 tries to return to its original state by the volume elasticity of the ink. This force is given to the electrostrictive vibrator 5 through the vibrating plate 2, providing a stress in a direction opposite to that of the mechanical strain obtained from the driving circuit 6. That is, the electric-charge distribution causes a change in the electric-charge distribution, opposite to that during the original driving time, inside the electrostrictive vibrator 5. The change in the electric charge inside the electrostrictive vibrator 5 causes a voltage above the voltage supplied by drive voltage $V_0$ to be generated at the drive point 5a . The action and reaction with the electrostrictive vibrator 5 inside the ink passage 3 are periodically repeated by the vibration system of the mechanical construction of the ink jet recording head, the ink volume elasticity or the like. The voltage at the drive point 5a of the electrostrictive vibrator 5 at this time is as shown in (c) of FIG. 3.

However, if air bubbles are mixed into the ink passage 3, the change in the capacity of the ink passage 3 due to the mechanical strain of the electrostrictive vibrator 5, caused by the driving circuit 6, is absorbed by the change in the atmospheric pressure of the air bubbles, thus reducing or eliminating the movement of the ink. At this time, proper ink droplets cannot be obtained. Since there is no movement of the ink, strain larger than the strain caused by the driving circuit 6 is not caused in the electrostrictive vibrator 5. Therefore, a voltage greater than the voltage obtained from the driving circuit 6 does not develop at the drive point 5a thereof.

In this embodiment, the presence or absence of air bubbles in the ink passage 3 is detected by monitoring the voltage at the drive point 5a of the electrostrictive vibrator 5 by means of the air-bubble detection circuit 7.

That is, when air bubbles are not present, ink is moved properly. In response to this, a voltage above the drive voltage $V_0$ develops at the drive point 5a of the electrostrictive vibrator 5 at times in accordance with the construction of the ink jet recording head and the properties of the ink. When air bubbles are generated, a voltage above the drive voltage $V_0$ does not develop at the drive point 5a . On the basis of this fact, the presence or absence of air bubbles is detected.

Detection of air bubbles by the air-bubble detection circuit 7 is performed as described below.

When the electrostrictive vibrator 5 is driven by the driving circuit 6 at a low voltage, the diode 22 is biased in a forward direction, and electric current flows in a forward direction. If the voltage across the diode 22 exceeds the threshold value of the diode 22, the forward current increases sharply. As a result, almost all the driving voltage that the electrostrictive vibrator 5 receives is divided by the resistor 21. Also, if the resistance value of this resistor 21 is taken to be a large value, no influence is exerted upon the driving circuit 6. In contrast, since the voltage developed by the mechanical strain reaches a voltage higher than drive voltage $V_0$, the diode 22 is biased in a reverse direction. At this time, since the backward current of the diode 22 is smaller than the forward current by an order of three or more, almost all the voltage of the electrostrictive vibrator 5 is divided to the diode 22. Therefore, as shown in FIG. 3(*d*), the cathode terminal voltage resulting almost from the mechanical strain of the electrostrictive vibrator 5 is taken out as it is from the cathode terminal of the diode 22. The voltage amplitude of the cathode terminal voltage is coupled as an alternating current by the capacitor 23, taken out as an alternating voltage shown in FIG. 3(*e*), applied to the bias point by the resistor 24, and input to the +input terminal of the voltage comparator 25. This input voltage is compared by the voltage comparator 25 with a reference voltage value formed by the voltage value of the battery 26, for example, 1 V, for distinguishing the presence of air bubbles.

In a case where there are no air bubbles in the ink passage 3, the alternating voltage shown in FIG. 3(*e*) varies beyond the reference voltage value. Therefore, a pulse shown in FIG. 3(*f*) is output to an output terminal 27 of the voltage comparator 25 as a result of determining that it is a voltage developed by mechanical strain when there are no air bubbles. Thus, the fact that there are no air bubbles is detected.

On the other hand, in a case where there are air bubbles in the ink passage 3, since the input voltage to the voltage comparator 25 is 0 volt despite the fact that the ink jet recording head is driven, no pulse is generated in the output terminal 27. Thus, it is determined that there are air bubbles in the ink passage 3.

A second embodiment of the air-bubble detection apparatus of the ink jet recording head of the present invention will be explained below with reference to FIGS. 4 and 5.

In this embodiment, pulses are generated at times when mechanical strain occurs in each ink jet recording head with the timing of driving the driving circuit 6 as a reference, and the level of the pulse state of the output from voltage comparator 25 is monitored at this time. Thus, the presence or absence of air bubbles in the ink jet recording head can be reliably determined. During manufacturing, variations occur in the ink jet recording head. As a result, the time when voltage peaks due to mechanical strain which develops at the electrostrictive vibrator 5, is different for each ink jet recording head.

For this reason, in this embodiment, the time when the output from the voltage comparator 25 is judged is determined for each ink jet recording head prior to printing or at another proper time.

Figure 4:
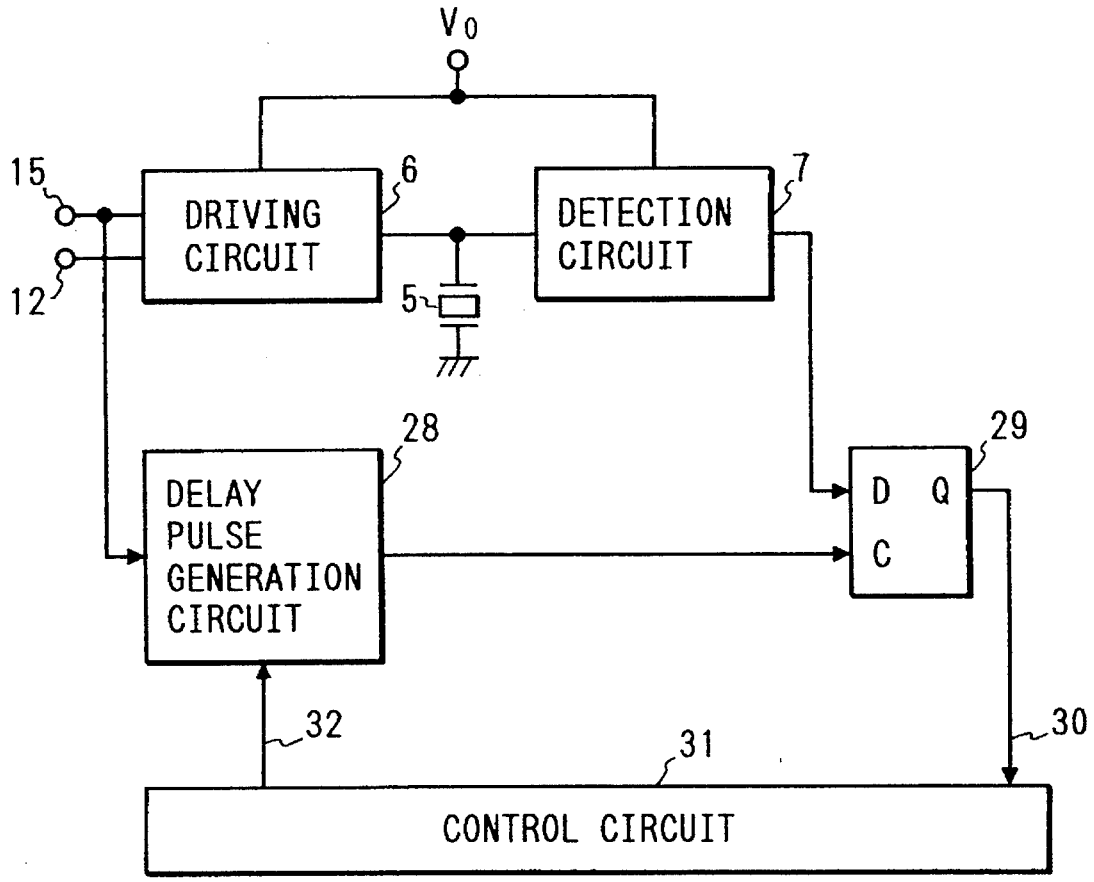
FIG. 4 is a view illustrating the construction of a checking time determination circuit.

FIG. 4 shows a circuit for determining the checking time. This checking time determination circuit is made up of a delay pulse generation circuit 28 which generates pulses at various times with the driving pulse outputted from the driving circuit 6 as a reference; a latch circuit 29 which samples the output of the voltage comparator 25 when a pulse is generated by the delay pulse generation circuit 28 and outputs it as a comparison result 30; and a control circuit 31 which supplies a pulse generation time setting signal 32 to the delay pulse generation circuit 28 and judges the comparison result 30.

Next, the operation of this embodiment will be explained.

The pulse generation time setting signal 32 is output to the delay pulse generation circuit 28 by the control circuit 31 prior to printing or at another proper time while each signal 32 is delayed by time At. As a result, the delay pulse generation circuit 28 receiving the high electrical-potential drive timing signal from the input terminal 15 generates a first pulse at the rise time of the high electrical-potential drive timing signal, as shown in FIG. 5(*d*). Thereafter, the second and following pulses are generated while they are delayed from one another by time Δt. The latch circuit 29 receiving pulses from the delay pulse generation circuit 28 judges, for each pulse, the output from the air-bubble detection circuit 7, i.e., the presence or absence of the occurrence of an excess electrical potential of the electrostrictive vibrator 5, indicated as pulses a, b, c . . . shown in FIG. 5(*c*), and outputs the result to the control circuit 31 as the comparison result 30. In this embodiment, while pulses a, b, c . . . shown in FIG. 5(*c*) are generated, the comparison result 30 indicating that there is a pulse is output from terminal Q of the latch circuit 29. To explain more specifically, pulse "a" indicating the occurrence of the first excess electrical potential of the electrostrictive vibrator 5, the rise of pulse "a" is at the rise time of the n-th pulse of the delay pulse generation circuit 28, and the fall of pulse "a" is at the fall time of the m-th pulse of the delay pulse generation circuit 28. Thus, the comparison result 30 indicating that there is pulse "a" is output from the latch circuit 29 for the duration of the n-th to m-th pulses. It is detected in the control circuit 31 that the time when pulse "a" is generated is after a lapse of n·Δt from the rise time of the high electrical-potential drive timing signal, and that the time when pulse "a" disappears is after a lapse of m·Δt from the rise time of the high electrical-potential drive timing signal. Furthermore, the average time (n+m)·Δt/2 thereof is computed.

Therefore, when printing and detection of air bubbles are performed in succession after the above, the average time is set, using the pulse generation time setting signal 32, in the delay pulse generation circuit 28 by the control circuit 31, and the output of the voltage comparator 25 is sampled continuously by the latch circuit 29 for air bubbles. As a result, the presence or absence of air bubbles can be detected by reliably responding to the occurrence of the first excess electrical potential of the electrostrictive vibrator 5 provided in each ink jet recording head.

Figure 6:
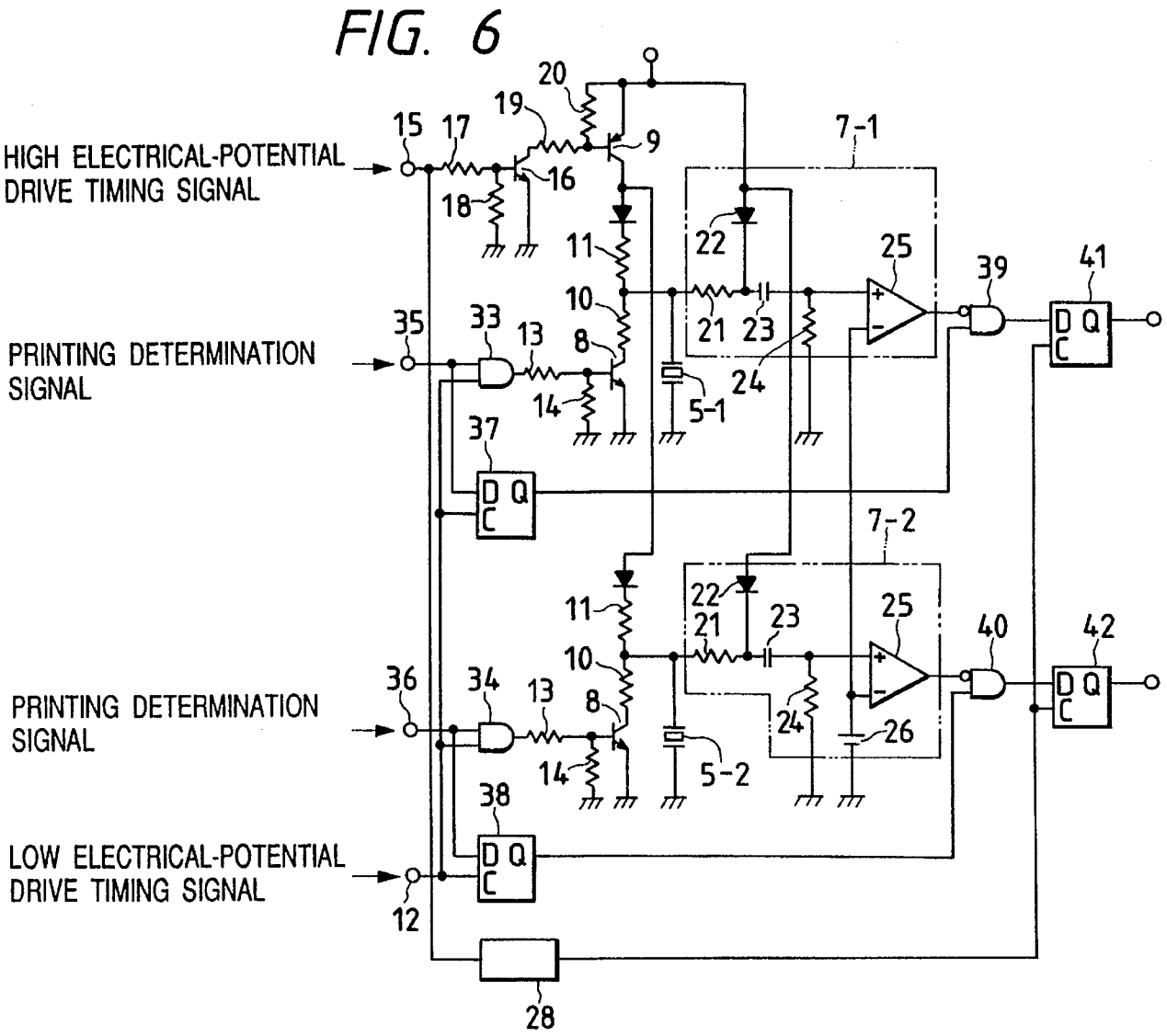
FIG. 6 is a circuit diagram which detects air bubbles in each jet nozzle when a plurality of nozzles are driven.

FIG. 6 shows a third embodiment of the air-bubble detection apparatus of the ink jet recording head of the present invention.

In this embodiment, when a plurality of nozzles are driven by a plurality of electrostrictive vibrators 5, 5 . . . , respectively, in the ink jet recording head, there are some cases where, when one of the electrostrictive vibrators 5 is being driven, the others are not driven. At this time, air-bubble detection is not performed in those electrostrictive vibrators 5 which are not driven.

FIG. 6 shows a circuit diagram therefor. Components in FIG. 6 which are the same as in FIG. 2 are given the same reference numerals.

In this embodiment, two electrostrictive vibrators 5-1 and 5-2 are driven at a high electrical potential by using the transistor 9 which is commonly used for the electrostrictive vibrators 5-1 and 5-2, and driven at a low electrical potential by using a transistor 8 for each of them. Air-bubble detection circuits 7-1 and 7-2 are provided on the electrostrictive vibrators 5-1 and 5-2, respectively. AND gates 33 and 34 are respectively connected to the input terminals of the low electrical-potential driving sections of the air-bubble detection circuits 7-1 and 7-2. A printing determination signal is input to each one of the input terminals of the AND gates 33 and 34, respectively, through input terminals 35 and 36. A low electrical-potential drive timing signal is input to each of the other input terminals of the AND gates 33 and 34 through an input terminal 12. Latch circuits 37 and 38 for storing printing determination signals at low electrical-potential drive timing are respectively provided in the low electrical-potential drive sections of the driving circuit 6. The latch circuits 37 and 38 serve as nozzle judgment means by which a nozzle from which ink droplets are to be jetted is identified. The printing determination signal is input to D terminals of the latch circuits 37 and 38 through the input terminals 35 and 36, respectively. A low electrical-potential drive timing signal is input to each of the C terminals of the latch circuits 37 and 38 through the input terminal 12. Logic gates 39 and 40 which output detection of air bubbles as true when the printing determination data stored by the latch circuits 37 and 38 indicates printing, are provided respectively on the output sections of the air-bubble detection circuits 7-1 and 7-2. Output from each of the air-bubble detection circuits 7-1 and 7-2 is input to each one of the input terminals of the logic gates 39 and 40, and the output from the Q terminal of each of the latch circuits 37 and 38 is input to the other input terminals thereof. Furthermore, there are provided latch circuits 41 and 42 in the logic gates 39 and 40, respectively. The latch circuits 41 and 42 are similar to latch circuit 29 of the above-described embodiment which samples the output of the logic gates 39 and 40 and judges and retains the presence or absence of air bubbles at times determined with high electrical-potential drive timing signals as a reference are provided. Pulses from the delay pulse generation circuit 28 are input to each of C terminals of the latch circuits 41 and 42, and the outputs from the logic gates 39 and 40 are input to each of the D terminals of the latch circuits 41 and 42.

Next, the operation of this embodiment will be explained.

First, during high electrical-potential driving, a high electrical-potential drive timing signal is input through the input terminal 15, thereby applying a high electrical potential to the electrostrictive vibrators (two electrostrictive vibrators 5-1 and 5-2 in this embodiment) of all the nozzles. Next, a printing determination signal prepared for each of the nozzles and a low electrical-potential drive timing signal common to all the nozzles are passed through the AND gates 33 and 34 and input to those nozzles where printing is performed, and a low electrical potential is applied to responding electrostrictive vibrators 5-1 and 5-2. At this time, printing determination data is stored for each nozzle by latch circuits 37 and 38 in response to the low electrical-potential drive timing signal. The outputs from the latch circuits 37 and 38 are logically operated on the basis of the outputs from the air-bubble detection circuits 7-1 and 7-2 and each of the logic gates 39 and 40. This logical-operation output of each of the logic gates 39 and 40 is latched by latch circuits 41 and 42 in response to pulses generated by the delay pulse generating circuit 29 with the high electrical-potential drive timing signal as a reference. As a result, it can be determined whether air bubbles are present in nozzles which should be driven at a low electrical potential and from which ink droplets are to be jetted.

Figure 7:
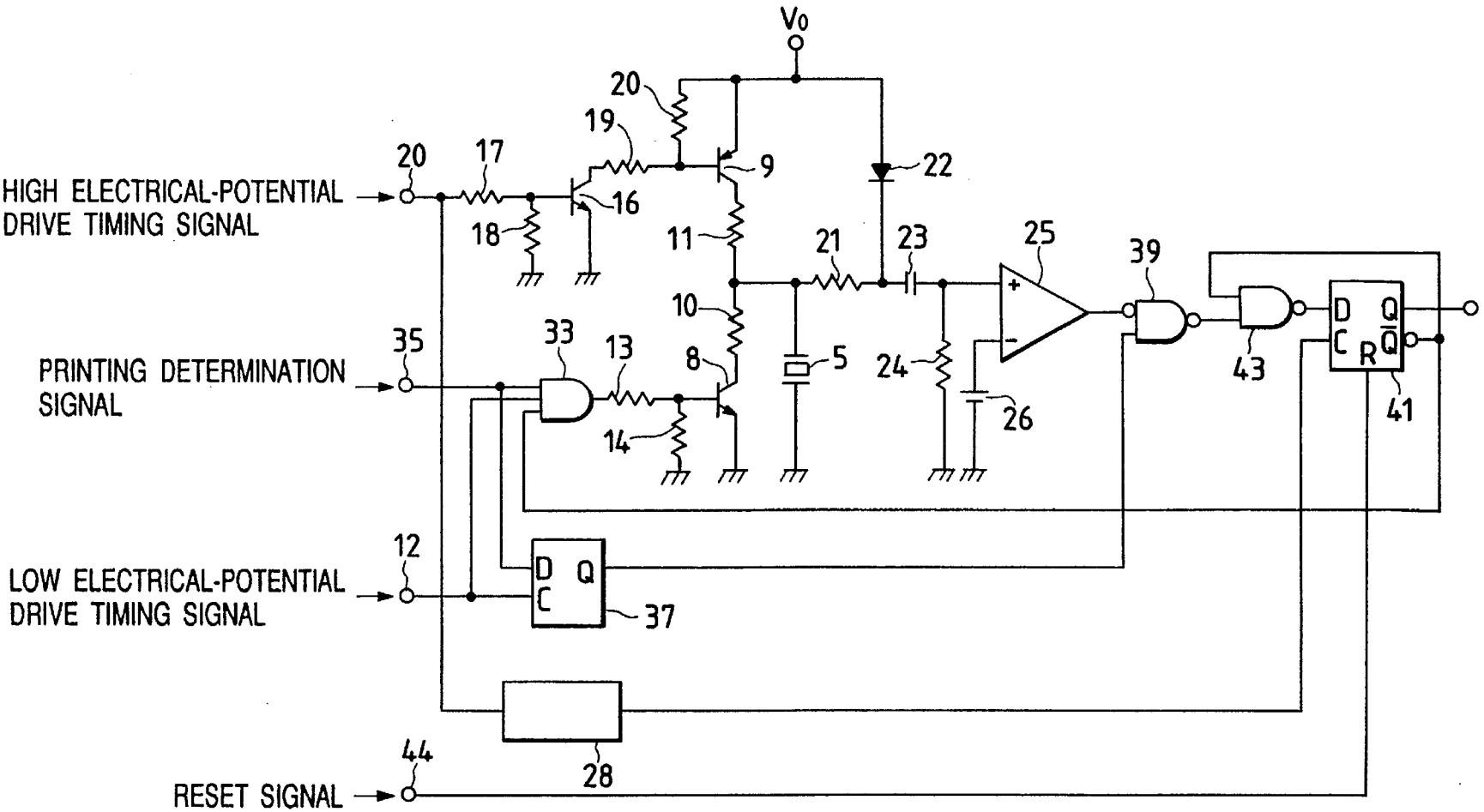
FIG. 7 is a circuit diagram which stops the discharge of ink droplets when air bubbles are detected.

FIG. 7 shows a fourth embodiment of the air-bubble detection apparatus of the ink jet recording head of the present invention, and a circuit diagram for stopping the discharge of ink droplets when the occurrence of air bubbles is detected.

When ink droplets are jetted while the ink jet recording head is moving in the direction of printing, air bubbles are sometimes generated in the ink passage 3 during the movement of the ink. When the generated air bubbles become gradually larger in the process of jetting, the ink droplets may become gradually smaller after detection of the air bubbles, or the jetting direction may be disturbed, deteriorating the quality of printing. Therefore, it is desirable that the ink jetting be stopped when air bubbles occur. In this embodiment, the jetting of ink is discontinued when the occurrence of air bubbles is detected.

Components in FIG. 7 which are the same as in FIG. 6 are given the same reference numerals.

In this embodiment, a logic gate 43 which forms logic for retaining the occurrence of air bubbles when it is once detected is provided between the logic gate 39 and the latch circuit 41 in the circuit of a single electrostrictive vibrator 5, shown in FIG. 6. The presence or absence of air bubbles is continuously detected during each high electrical-potential driving. That is, the inverted output of the Q bar terminal of the latch circuit 41 is input to one of the the input terminals of the logic gate 43, and the output of the logic gate 39 is input to the other input terminal. The inverted output of the Q bar terminal of the latch circuit 41 is also input to AND gate 33 of the low electrical-potential driving section of the driving circuit 6. As a result, AND gate 33 is driven at a low electrical potential at the low electrical-potential drive timing in accordance with: printing determination data when air bubbles are detected; the low electrical-potential drive timing signal; and the inverted output of the latch circuit 41 for judging if air bubbles are detected. When air bubbles are detected, low electrical-potential driving is stopped regardless of the state of the printing determination data. The reset terminal of latch circuit 41 is so formed that a reset signal is input thereto through input terminal 44.

Next, the operation of this embodiment will be explained.

First, the latch circuit 41 is initialized to logic value 0 by a reset signal inputted from input terminal 44 before the ink jet recording head starts moving.

Thereafter, air bubbles may occur in the ink passage 3 when printing is being performed continuously. This is detected by the air-bubble detection circuit 7, and a logic value 1 indicating the detection of air bubbles is stored in the latch circuit 41. Thereupon, an inverted output is output to AND gate 33 and logic gate 43 from the Q bar terminal. The AND gate 33 receiving this inverted output stops the low electrical-potential driving regardless of the state of the printing determination data. In contrast, if the logic gate 43 receives the inverted output indicating the occurrence of air bubbles, during printing, the operation for retaining the latch circuit 41 to a logic value 1 is performed. As a result, the jetting of ink is stopped when air bubbles occur.

When ink is jetted from a plurality of nozzles simultaneously, the jetting at each of the nozzles can be stopped by a method in which each of the nozzles has a latch arrangement shown in FIG. 7. An inverted output therefrom is additionally input to AND gates 33 and 34 in FIG. 6 provided in the low electrical-potential drive section of each nozzle. It is also possible that logic AND of the outputs of all the latches is produced, thereby stopping the jetting of all the nozzles simultaneously. Particularly, when the jetting of all nozzles is stopped simultaneously, the low electrical-potential drive timing signal may be stopped instead of supplying a stop signal to AND gates 33 and 34 which determine the low electrical-potential driving of individual nozzles.

Figure 8:
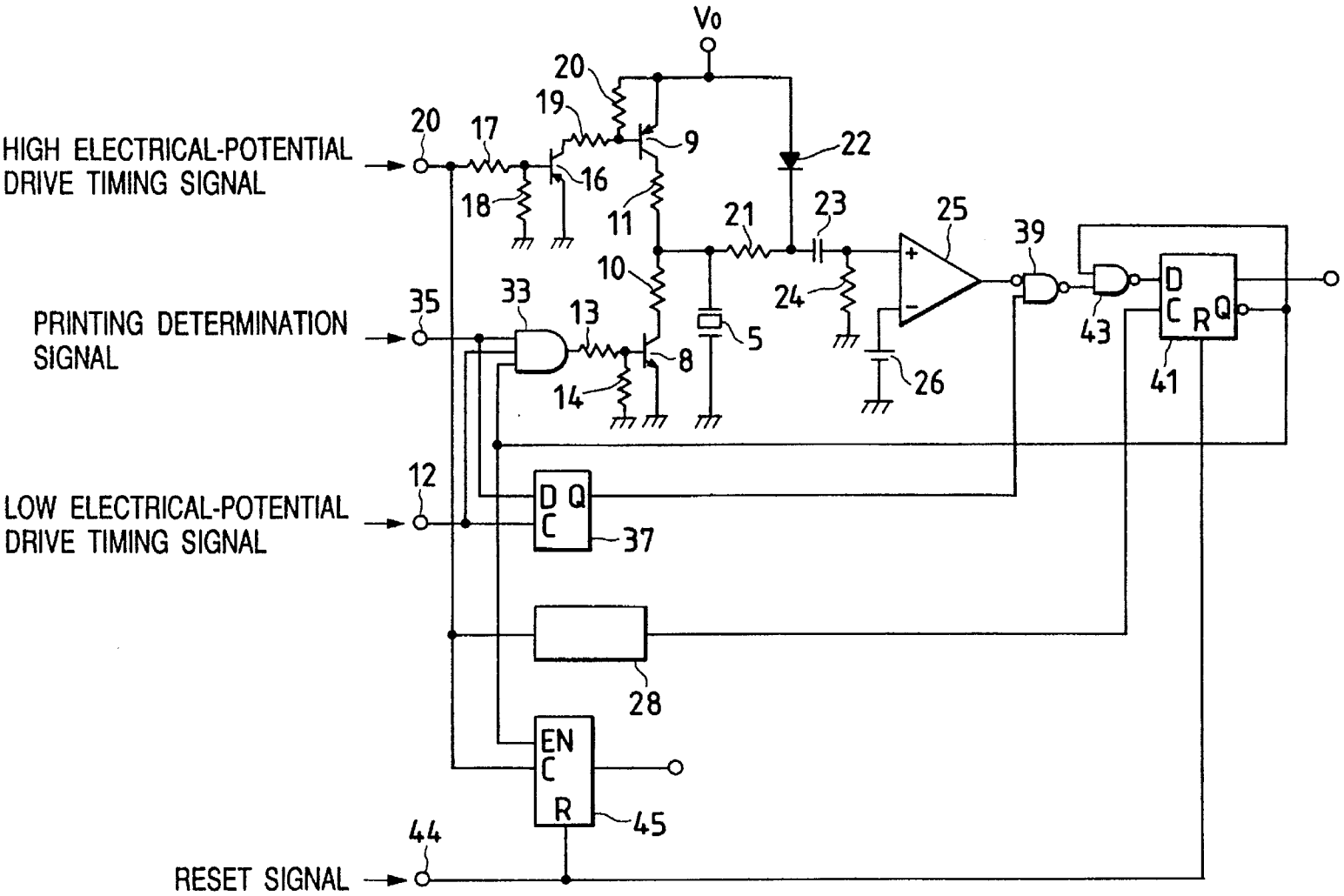
FIG. 8 is a circuit diagram which stores the positions at which air bubbles in the ink head are detected.

FIG. 8 shows a fifth embodiment of the air-bubble detection apparatus of the ink jet recording head of the present invention.

In this embodiment, positions are stored to which the ink jet recording head is moved when air bubbles in the ink passage 3 of the ink jet recording head are detected.

The case where printing is performed while the ink jet recording head is moving was explained in the embodiment shown in FIG. 7. The driving of the electrostrictive vibrator 5 is stopped when air bubbles are detected so that the quality of printing does not deteriorate while the operation for detecting air bubbles being is performed.

In contrast, to stop the movement of the ink jet recording head when the discharge of ink droplets is stopped, a mechanical driving circuit which overcomes the inertial force of the ink jet recording head is required. Thus, it is difficult to stop the ink jet recording head moving at high speed, with a high degree of accuracy.

Therefore, in this embodiment, even if air bubbles in the ink passage 3 are detected, the movement of the ink jet recording head is not stopped. Only the discharge of ink droplets is stopped, and that time, i.e., the position where the printing is discontinued is stored.

Thereafter, the ink jet recording head which moves during printing is stopped gradually after passing the region to be printed. Then, whether air bubbles are detected is determined by the air-bubble detection circuit 7 while the ink jet recording head is moving and printing is being performed. When air bubbles are detected, the operation for discharging air bubbles is initiated, and the inside of the ink jet recording head is restored in preparation for subsequent printing. After being restored, printing is restarted. At this time, the ink jet recording head moves gradually to the position where air bubbles were detected without jetting ink droplets. Upon reaching that position, the ink jet recording head starts printing on the portion which is not yet printed. As a result, the jetting of ink droplets, stopped when air bubbles are detected, matches the starting point at which printing is restarted after the air bubbles inside the head are discharged. Thus, printing which is discontinued when air bubbles are detected can be recommenced smoothly.

In this embodiment, shown in FIG. 8, which makes the above-described operation possible, the position to which the ink jet recording head moves when air bubbles in the ink passage 3 of the ink jet recording head are detected is stored, and a counter circuit 45 is added to the circuit of FIG. 7.

The counter circuit 45 counts printing unit positions from the start of the movement of the ink jet recording head to the position where air bubbles are detected. A high electrical-potential drive timing signal is input to C terminal of the counter circuit 45, and an inverted output from Q bar terminal of the latch circuit 41 is input to EN terminal thereof. The counter circuit 45 increments by 1 on the basis of the high electrical-potential drive timing signal when air bubbles are not detected. When air bubbles are detected, the counter circuit 45 retains the counted value regardless of the status of the high electrical-potential drive timing signal.

Next, the operation of this embodiment will be explained.

First, before the movement of the ink jet recording head is started, a reset signal is input at least once to the counter circuit 45 and the latch circuit 41 from the input terminal 44 so that the circuits are set to an initial value of 0.

Thereafter, the movement of the ink jet recording head is started to perform printing, and a high electrical-potential drive timing signal is generated. When printing, a low electrical-potential drive timing signal is generated as required in synchronization with the high electrical-potential drive timing signal, so that ink droplets are discharged. At this time, the presence of air bubbles may be detected. When air bubbles are not detected, the counter 45 is incremented by 1 in accordance with the high electrical-potential drive timing signal. When air bubbles are detected, the latch circuit 41 becomes true. For this reason, the counter circuit 45 stores the current value even if a high electrical-potential drive timing is generated.

When restarting printing after the above, the stored position where air bubbles are detected while the ink jet recording head is moving is output as the value for the counter, making it possible to perform printing satisfactorily after the printing is discontinued.

Next, an embodiment of a method and apparatus for restoring the ink jet recording head of the present invention will be explained.

Figure 9:
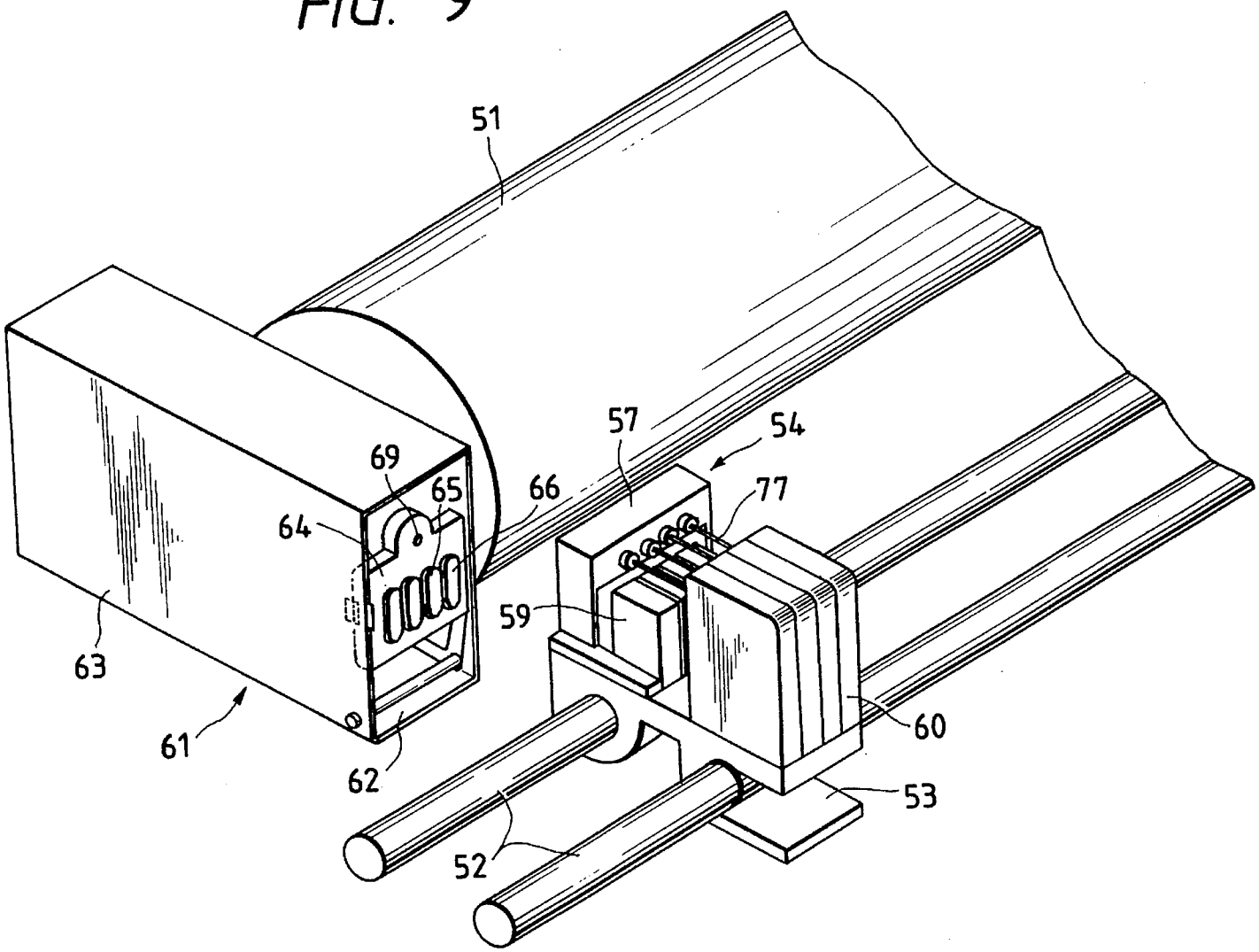
FIG. 9 is a perspective view of an essential portion of an ink jet recording apparatus to which the restoring method of the present invention is applied.
Figure 10:
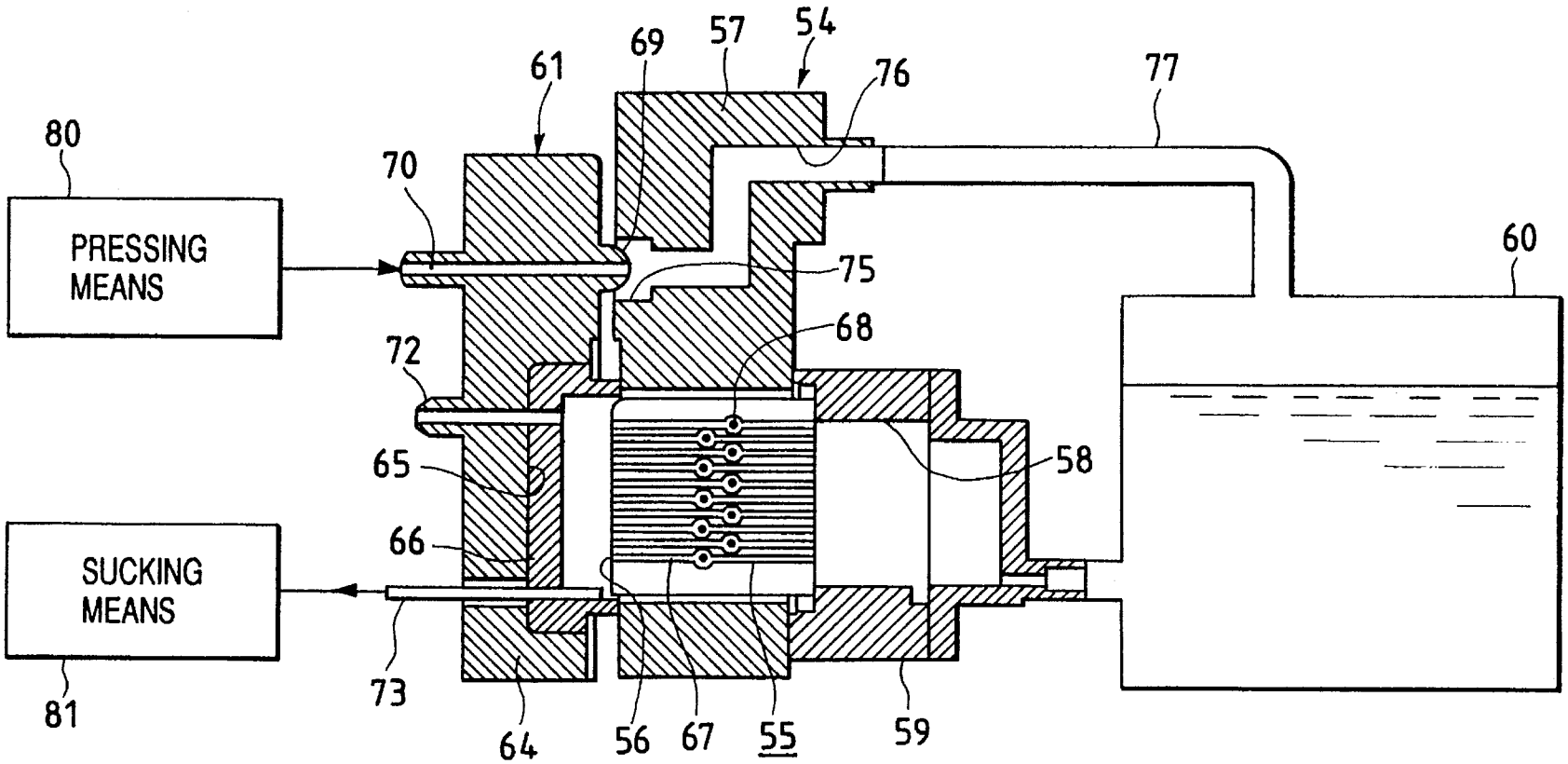
FIG. 10 is a sectional view of an essential portion of a recording head portion of the ink jet recording apparatus shown in FIG. 9.

FIG. 9 is a perspective view of an essential portion of an ink jet recording apparatus to which the restoring method of the present invention is applied. FIG. 10 is a sectional view of an essential portion of the recording head portion of the ink jet recording apparatus.

A pair of carriage shafts 52 and 52 extending in a direction parallel to the axis of a platen 51 are disposed in front of the cylindrical platen 51 in the ink jet recording apparatus, as shown in FIGS. 9 and 10. A reciprocatable carriage 53 is disposed along the carriage shafts 52 and 52. An ink jet head 54 for full-color printing is mounted on the carriage 53.

Four nozzle assemblies 55 (see FIG. 10) corresponding respectively to four color inks for full color printing are disposed in such a manner as to face the platen 51. Each of the nozzle assemblies 55 is formed of a plurality of nozzles 56 (see FIG. 10) arranged longitudinally in such a manner as to face the platen 51. These nozzle assemblies 55 are fixed to a head mount base supported on the carriage 53.

An inlet 59 having an auxiliary tank 58 incorporated therein, which serves as a buffer tank which communicates with each of the nozzles 56 constituting the nozzle assemblies 55, is disposed on the carriage 53 behind each of the nozzle assemblies 55. Ink cartridges 60 for corresponding colors, releasably mounted on the carriage 53, communicate with each of the inlets 59.

A capping apparatus 61 for covering each nozzle 56 to prevent the ink inside the nozzle 56 from drying when not in use, and for removing the air bubbles formed in the nozzles 56 and foreign matter stuffed in the nozzles 56, is disposed on one end of the platen 51. The capping apparatus 61 has a casing 63 having an opening 62 formed on a portion of the carriage 53. A capping main body 64 movable in such a manner that it contacts and separates from the ink jet head 54 is disposed inside the opening 62 of the casing 63. The capping main body 64 has a plurality of openings 65 longitudinally in correspondence with each nozzle assembly 55 of the ink jet head 54 so as to cover each nozzle assembly 55. A rubber-made liner 66 is stretched in the inner side of each of the openings 65. The liner 66 projects outwardly from the inner side of the peripheral edge of each of the openings 65 to form an air-tight contact with the outer circumference of each of the nozzle assemblies 55.

Figure 5:
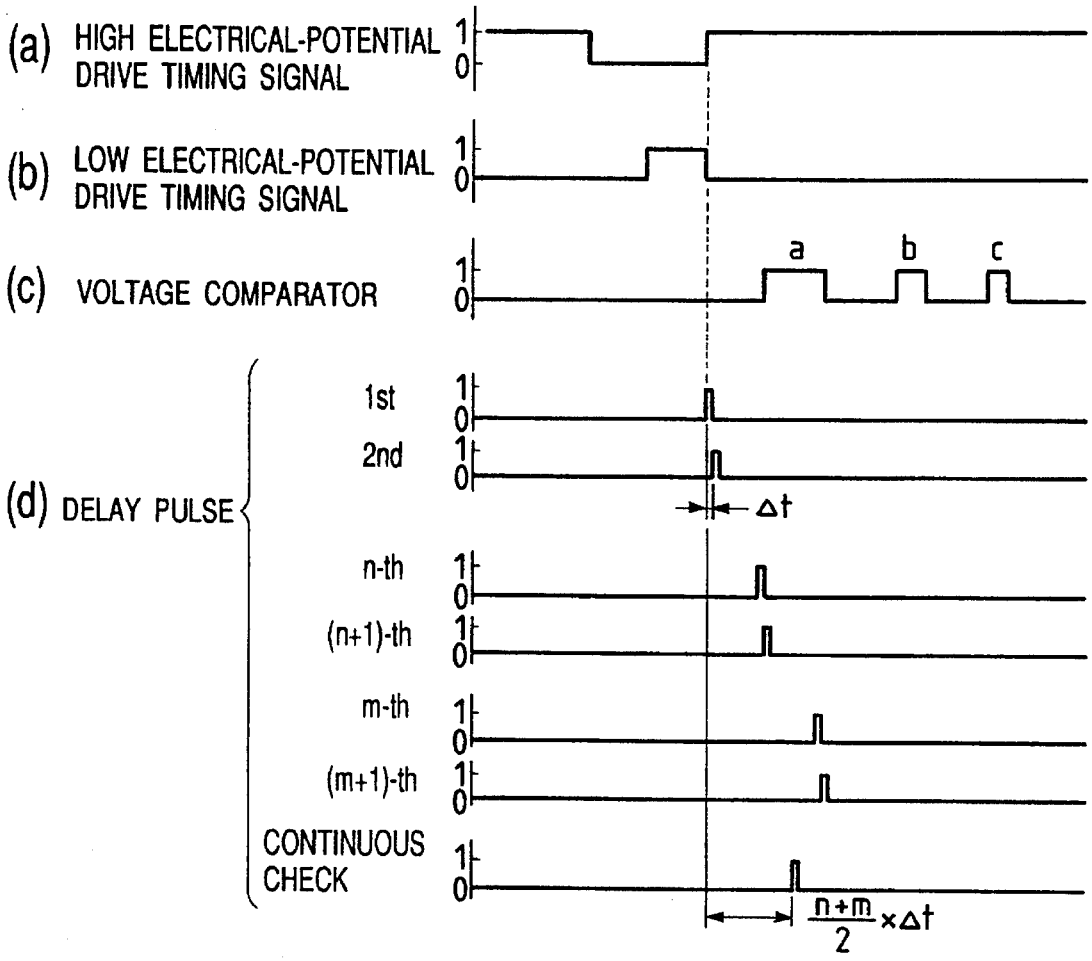
FIG. 5 is a waveform chart illustrating the waveforms of each section of the checking time determination circuit shown in FIG. 4.

As shown in FIG. 5, the nozzle assemblies 55 are formed of a plurality of ink passages 67 each arranged longitudinally. A piezoelectric element 68, which is an electrostrictive vibrator for jetting ink from the nozzle 56 in the extreme end portion of each of the ink passages 67, is disposed in each of the ink passages 67.

A single substantially semicircular projection 69 is provided on the upper, front side of the capping main body 64. A pressurizing air conduit 70, which communicates with the top portion of the projection 69, is formed so as to reach the rear portion of the capping main body 64. Pressurizing means 80, such as a pump, is connected to the air conduit 70. Each of the openings 65 of the capping main body 64 communicates with an unillustrated air open valve through a communication passage 72. A waste-liquid pipe 73 is connected to each of the openings 65 of the capping main body 64. Each of the waste-liquid pipes 73 is connected to a sucking means 81, such as a pump. The ink sucked in from each of the openings 65 is stored in a waste-liquid tank by the sucking means 81.

In contrast, a single pressurizing air conduit 75, which communicates with the air conduit 70 as a result of the projection 69 contacting the nozzle when the capping apparatus 61 covers the ink jet head 54, is formed on the upper portion on the side facing the capping apparatus 61 of the head mount base 57. The air conduit 75 branches to four branch passages 76 corresponding to the number of ink cartridges 60. An air pipe 77 which communicates with the upper portion of the inside of each of the ink cartridges 60 is connected to the end portion of each of the branch passages 76.

According to the above-described ink jet recording apparatus, printing is performed as desired in the manner described below. The piezoelectric element 68 of the nozzle 56 of the ink jet head 54 is operated on the basis of a predetermined printing signal while the carriage 53 having the ink jet head 54 mounted thereon moves along the platen 51 during printing with the capping main body 64 of the capping apparatus 61 retracted, so that the desired ink is supplied from the ink cartridge 60 through the inlet 59 to the ink passage 67 and jetted from the nozzle 56 toward the paper on the platen 51.

At this time, the air-bubble detection apparatus monitors the occurrence of air bubbles. Upon detection, printing is discontinued, and a restoring operation is performed by the restoring apparatus to remove air bubbles from the ink passage 67.

Figure 11:
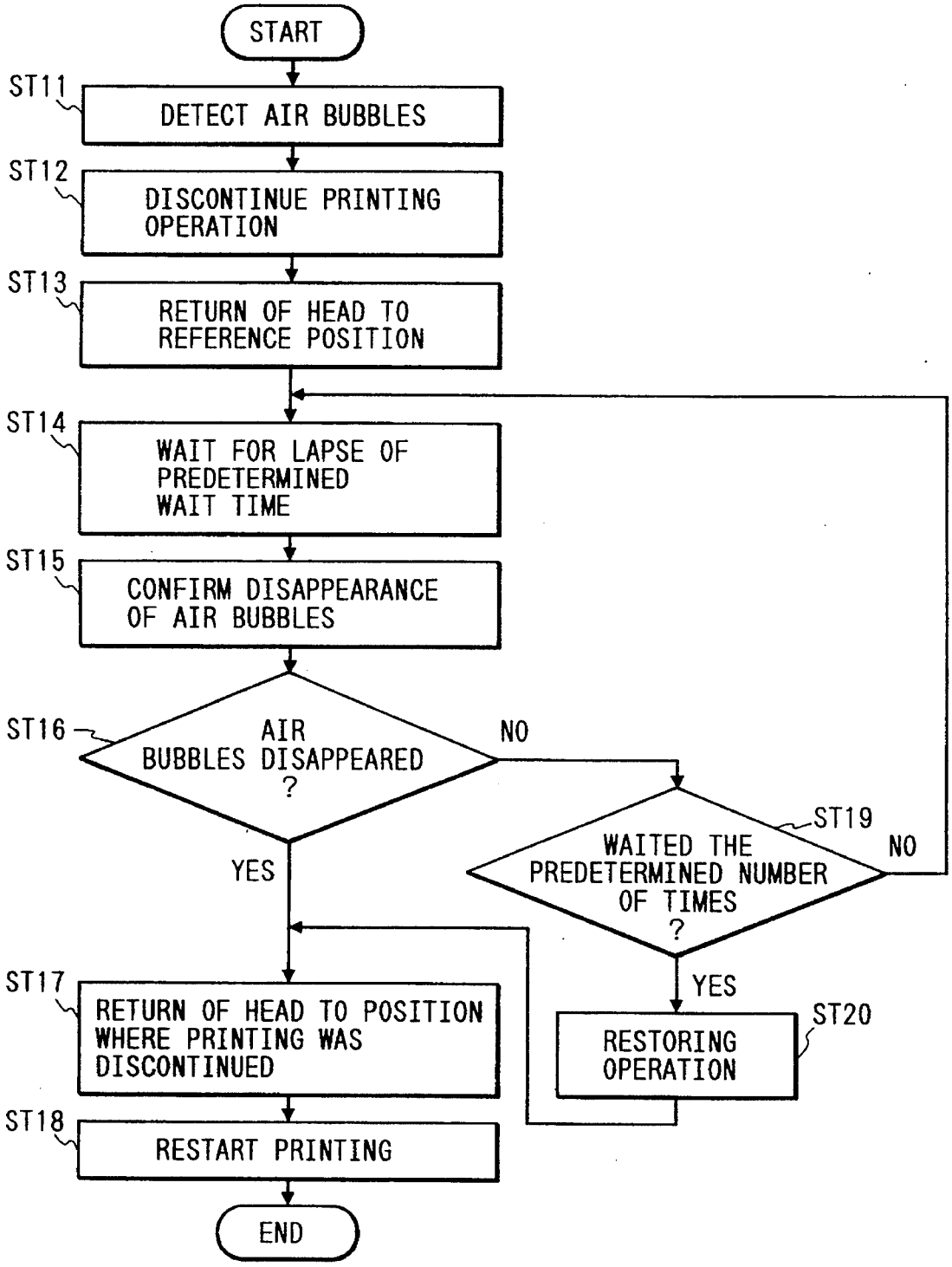
FIG. 11 is a flowchart showing an embodiment of the method of restoring the ink jet recording head according to the present invention.

Detection of air bubbles in the ink passage in this embodiment is performed by the air-bubble detection apparatus explained with reference to FIGS. 2 and 3. The restoring operation after the occurrence of air bubbles is detected is performed in accordance with the sequence shown in the flowchart of FIG. 11.

First, when the occurrence of air bubbles is detected in step ST11, the process proceeds to step ST12 where the printing operation is immediately stopped. Next, the process proceeds to step ST13 where the ink jet head 54 returns to the reference position where it faces the capping apparatus 61. Then, the process proceeds to step ST14 where the apparatus stops for a predetermined waiting time for the air bubbles to diffuse into the ink and disappear. The higher the temperature of the ink and ambient temperature, the shorter the time required for the air bubbles to diffuse into the ink. Therefore, the waiting time changes according to the temperature of the ink and ambient temperature. It is desirable that an appropriate display lamp or the like be lit during the waiting time to indicate to the user that the apparatus is on "stand-by".

After a lapse of the above waiting time, the process proceeds to step ST15 and ST16, in which steps the piezoelectric element 68 is driven one time with the ink jet head 54 covered with the capping main body 64 of the capping apparatus 61, in order to detect whether air bubbles still remain by the above-mentioned air-bubble detection circuit 7 in a manner similar to the above.

When the results of this detection indicate that air bubbles have disappeared, the process proceeds to step ST17 where the ink jet head 54 is returned to the place where the printing was discontinued. Then, the printing is restarted in step ST18.

When air bubbles have not yet disappeared, the process proceeds to step ST18 where it is determined whether the number of times of waiting periods has reached a predetermined number, for example, 2. When the predetermined number has not been reached, the process returns to step ST14 where the restoring operation up to step ST16 is performed again. When the predetermined number has been reached, the process proceeds to step ST20 where the restoring apparatus shown in FIGS. 9 and 10 is operated so that pressurized air is supplied to the pressurizing air conduit 70 to discharge air bubbles in the ink passage 67 into the opening 65 of the capping main body 64, thereby restoring the ink jet head 54 actively to an operating condition. Thereafter, the process proceeds to step ST17 where the printing operation is restarted.

As described above, according to this embodiment, when air bubbles which occur in the ink passage 67 are very small and can be diffused into the ink in a short time, the printing operation is discontinued for at least that amount of time in which the air bubbles are diffused, causing the air bubbles to diffuse into the ink and disappear. The printing operation is restarted thereafter, and the operation for restoring the ink jet head can be performed in a short time. Thus, the restoring operation using a restoring apparatus as in the prior art, which takes a long time, is obviated, making high-speed printing possible.

Next, another embodiment of the method and apparatus for restoring the ink jet recording head of the present invention will be explained.

Detection of air bubbles in the ink passage in this embodiment is performed by the air-bubble detection apparatus explained with reference to FIGS. 2 and 3, in the same manner as in the above-described embodiment.

Figure 12:
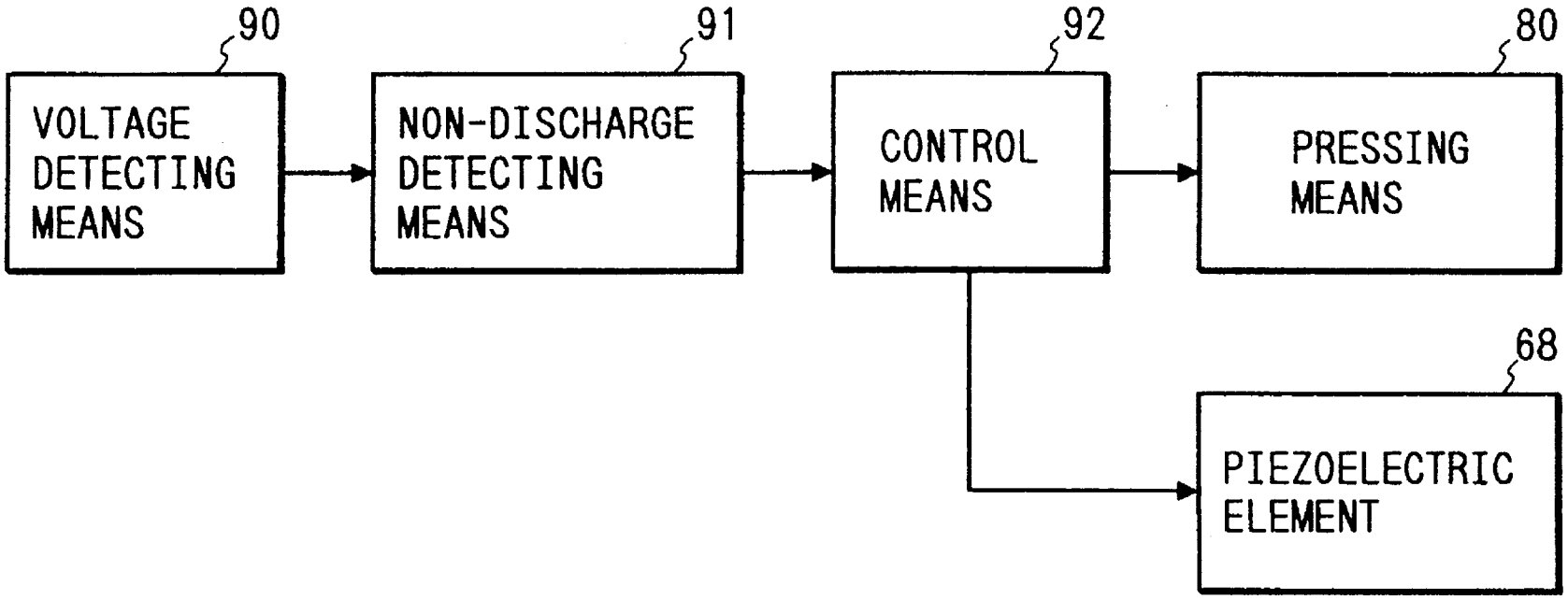
FIG. 12 is a circuit block-diagram illustrating an embodiment of an apparatus for restoring the ink jet recording head according to the present invention.

FIG. 12 shows a restoring apparatus of this embodiment. It is applied to the ink jet recording apparatus and the recording head, constructed as shown in, for example, FIGS. 9 and 10.

Referring to FIGS. 9 and 10, strain is caused in the piezoelectric element 68 by the ink being moved in the ink passages 67 of the ink jet head 54. This strain induces a voltage across the piezoelectric element 68. Accordingly, the restoring apparatus of the ink jet head of this embodiment has voltage detecting means 90 for detecting the voltage across the piezoelectric element 68, as shown in FIG. 12.

Non-discharge detecting means 91 for outputting the detected voltage is connected to the voltage detecting means 90. The non-discharge detecting means 91 outputs a non-discharge signal, indicating that one of the nozzles 56 is not in a discharge state, to control means 92 for performing various controls of the ink jet printer on the basis of an output from the voltage detecting means 90 detecting the voltage across the piezoelectric element 68, which voltage develops when the specific nozzles 56 is not in a discharge state due to clogging, air bubbles or the like.

The control means 92 outputs a driving signal to the pressurizing means 80, such as a pump for applying pressure to the ink cartridge 60, an ink tank, during the time a non-discharge signal from the non-discharge detecting means 91 is input. An unillustrated pressure measuring instrument is connected to the pressing means 80, by which the internal pressure of the ink cartridge 60 is measured so as to maintain the internal pressure thereof at a set value.

The piezoelectric element 68 corresponding to each of the nozzles 56 is connected to the control means 92. During the time a non-discharge signal from the non-discharge detecting means 91 is input, the piezoelectric element 68 corresponding to the non-discharge nozzle 56 is driven. After it is driven for one time when the inside of the ink cartridge 60 reaches a predetermined pressure by the operation of the pressing means 80 when the non-discharge signal from the non-discharge detecting means 91 is input, the piezoelectric element 68 corresponding to the non-discharge nozzle 56 is driven each time the timer incorporated in the control means 92 performs a measurement.

Next, the operation of this embodiment constructed as described above will be explained.

First, when normal printing is performed by the ink jet printer, the platen 51 shown in FIG. 9 is rotated to feed unillustrated paper to a predetermined printing position. In this state, the piezoelectric element 68 of the ink jet head 54 is operated on the basis of a predetermined printing signal while the carriage 53 moves along the carriage shaft 52, causing ink of a desired color supplied from the ink cartridge 60 to be jetted to the paper from the nozzle 56 of the ink passage 67. Thus, printing can be performed as desired.

During printing, the voltage across the piezoelectric element 68 corresponding to each of the nozzles 56 is detected by the voltage detecting means 90. The voltage of each of the piezoelectric elements 68 is output from the voltage detecting means 90 to the non-discharge detecting means 91 where which nozzle 56 is in a non-discharge state is detected. Accordingly, when ink cannot be discharged from a nozzle 56 in the ink passage 67 because the ink passage 67 of the ink jet head 54 is clogged or air bubbles occur, the non-discharge detecting means 91 outputs a non-discharge signal indicating which nozzle 56 is in a non-discharge state to the control means 92.

The control means 92 receiving the non-discharge signal stops the printing and returns the carriage 53 to its home position. The air open valve 72 of the capping main body 64 is opened at the home position, and then the ink jet head 54 is covered with the capping main body 64 of the capping apparatus 61. Thereafter, the internal pressure of each of the ink cartridges 60 can be increased in a state in which the air open valve 72 of the capping main body 64 is opened, and then the pressurizing means 80 and sucking means 81 are operated.

Thereupon, pressurized air is supplied from the pressurizing air conduit 70 to each of the ink cartridges 60 through the air conduit 77, pressurizing the ink in each of the ink passages 67. If the internal pressure of each of the ink cartridges 60 reaches a set pressure higher than the atmospheric pressure by 0.3 pressures by the above pressurizing, the piezoelectric element 68 corresponding to the non-discharging nozzle 56 is driven for one pulse, jetting ink from this nozzle 56. Since jetting of the ink causes vibrations, clogging or air bubbles inside the nozzle 56 can be eliminated easily. The set pressure higher than the atmospheric pressure by 0.3 pressures is only one example of the lower limit of the atmospheric pressure at which the non-discharge state can be solved satisfactorily.

When the non-discharge condition is solved by driving the piezoelectric element 68 corresponding to the non-discharging nozzle 56, the non-discharge signal is no longer output to the control means 92 from the non-discharge detecting means 91. When the apparatus enters this state, an unillustrated pressurized air escape valve provided in the pressurizing passage from the pressing means 80 is opened. Thus, the restoring operation is terminated.

When a non-discharge signal is continuously outputted to the control means 92 from the non-discharge detecting means 91 even if the piezoelectric element 68 corresponding to the nozzle 56 from which ink cannot be discharged is driven for one pulse and ink is jetted from this nozzle 56, the timer (not shown) within the control means 92 measures the time from when the piezoelectric element 68 was driven last. When a set time elapses, the piezoelectric element 68 corresponding to the non-discharging nozzle 56 is driven for one pulse to jet ink from this nozzle 56 one more time. If the non-discharge condition of the nozzle 56 is solved by the jetting of ink, the unillustrated pressurized air escape valve is opened. This terminates the restoring operation. If the non-discharge condition continues, however, the above-described restoring operation is repeated at predetermined time intervals.

As described above, according to this embodiment, since the restoring operation is performed only when a non-discharge signal is output from the non-discharge detecting means 91, the time required for the restoring operation is short, and the amount of ink consumed for the restoring operation is small.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included with the spirit and scope of the claims. The following claims are to be accorded the broadest interpretation, so as to encompass all such modifications and equivalent structures and functions.

What is claimed is:

1. An air-bubble detection apparatus of an ink jet recording head, the ink jet recording head including an ink passage having a nozzle, the ink jet recording head also including an electrostrictive vibrator which contracts in response to a drive signal, wherein a contraction changes a volume of the ink passage in an absence of air bubbles such that ink is forced from the ink passage through the nozzle, said air-bubble detection apparatus further comprising:

a driving circuit for generating the drive signal applied to the electrostrictive vibrator, the drive signal including maximum voltage level;

air-bubble detecting means, connected to the driving circuit and to the electrostatic vibrator, for detecting an occurrence of air bubbles in the ink passage by measuring a vibrator voltage generated across the electrostrictive vibrator after contraction of the electrostrictive vibrator, and for generating an output signal only when the vibrator voltage exceeds the maximum voltage level by a predetermined amount;

a pulse generating circuit for generating pulses in response to the drive signal;

output judgment means for detecting a duration of the output signal generated by the air-bubble detecting means by identifying a start pulse and a stop pulse of the pulses generated by the pulse generating means which correspond with the output signal;

control means for computing an average time of the output signal based on the start and stop pulses, and for generating a timing signal after the calculated average time following each drive signal; and means for comparing the output signal and the timing signal and for generating a comparison signal when the timing signal coincides with the output signal.

2. A method of removing air bubbles from ink located in an ink passage of an ink jet recording head, the ink jet recording head including an electrostrictive vibrator connected to the ink passage such that an transmission of a drive signal to the electrostrictive vibrator causes ink to be expelled from a nozzle formed in the ink passage, the method comprising the steps of:

(a) detecting a presence of the air bubbles using an air-bubble detecting means;

(b) stopping transmission of the drive signal for at least a predetermined time period;

(c) detecting whether the air bubbles have been diffused into the ink by transmitting the drive signal and detecting a presence of the air bubbles using the air-bubble detecting means;

(d) stopping the transmission of the drive signal again for the predetermined time period if the air bubbles have not been diffused;

(e) determining whether a number of stoppages of the drive signal has reached a predetermined number of times; and (f) operating restoring means which forcedly discharges ink from the nozzle of the recording head if the air bubbles have not been diffused after the predetermined number of times.

3. A method for detecting air-bubbles in an ink jet recording head, the ink jet recording head including an ink passage having a nozzle, the ink jet recording head also including an electrostrictive vibrator for changing a volume of the ink passage in response to a drive signal such that ink is forced from the ink passage through the nozzle in response to an ink passage volume change, the method comprising:

generating the drive signal such that a first voltage level is applied across the electrostrictive vibrator followed by a momentary second voltage level, thereafter returning to the first voltage level;

detecting an occurrence of air bubbles in an ink passage by comparing a vibrator voltage generated across the electrostrictive vibrator with a reference voltage after the drive signal changes from the second voltage level to the first voltage level;

generating an output signal when the vibrator voltage is greater than the reference voltage;

wherein air bubbles are detected in the ink passage when the vibrator voltage remains less than the reference voltage after the drive signal changes from the second voltage level to the first voltage level;

determining a duration of the output signal;

generating a first plurality of pulses in response to the driving signal;

measuring a duration of the output signal using the first plurality of pulses and generating a second plurality of pulses corresponding to a duration of the output signal; and determining an average duration of the output signal in response to the second plurality of pulses and for transmitting a control signal to the pulse generating means;

wherein the first plurality of pulses is determined by the control signal.

4. A method for driving an ink jet printer having an ink jet recording head including an ink passage defining a nozzle, the method comprising the steps of:

(a) moving the ink jet recording head along a printing path;

(b) transmitting drive signals to the ink jet recording head such that ink is ejected from the nozzle to perform a desired printing operation along the printing path;

(c) detecting a presence of air bubbles within the ink passage using a detecting circuit;

(d) interrupting the transmission of the drive signals to the recording head when the presence of said air bubbles is detected;

(e) gradually stopping the movement of the ink let recording head and returning the ink let recording head to a point along the printing path which precedes an interrupted position at which the drive signals were interrupted;

(f) applying a recovering operation for removing air bubbles from the ink passage; and (g) restarting movement of the ink let recording head along the printing path and restarting the printing operation from the interrupted position of said recording head when said recovering operation is completed.

5. An ink jet recording apparatus comprising:

an ink jet recording head mounted on a carriage, the ink jet recording head including an ink passage having a nozzle, the ink jet recording head also including an electrostrictive vibrator disposed adjacent the ink passage;

a carriage drive mechanism for moving the carriage along a printing path;

a driving circuit for generating a driving voltage across the electrostatic vibrator;

an air-bubble detecting circuit for detecting a presence of air bubbles within the ink passage;

a recovering means for performing a recovering operation to remove air bubbles from said ink passage; and a control means for stopping the driving of said recording head when the presence of said air bubbles is detected to interrupt the printing operation, storing a position of said recording head, controlling the carriage drive mechanism to gradually stop the movement of the carriage and returning the drive mechanism to a point along the printing path preceding said stored position, and restarting the movement of said carriage and the printing operation from said stored position after said recovering operation is completed.

6. A method for driving an ink jet printer having an ink jet recording head including an ink passage defining a nozzle, the method comprising the steps of:

(a) moving the ink jet recording head along a printing path;

(b) transmitting drive signals to the ink jet recording head such that ink is ejected from the nozzle to perform a desired printing operation along the printing path;

(c) detecting a presence of air bubbles within the ink passage using a detecting circuit;

(d) interrupting the transmission of the drive signals to the recording head when the presence of said air bubbles is detected;

(e) gradually stopping the movement of the ink jet recording head;

(f) applying a recovering operation for removing air bubbles from the ink passage;

(g) returning the ink jet recording head to a point along the printing path which precedes an interrupted position at which the drive signals were interrupted; and (h) restarting movement of the ink jet recording head along the printing path and restarting the printing operation from the interrupted position of said recording head when said recovering operation is completed.

* * * * *